United States Patent [19]

Yoshimura

[11] Patent Number: 4,524,819

[45] Date of Patent: Jun. 25, 1985

[54] METHOD OF MANUFACTURING LEADED FREE-CUTTING STEEL BY CONTINUOUS CASTING PROCESS

[75] Inventor: Tsuneo Yoshimura, Tokyo, Japan

[73] Assignee: Mitsubishi Steel Mfg. Co., Ltd., Tokyo, Japan

[21] Appl. No.: 561,134

[22] Filed: Dec. 13, 1983

Related U.S. Application Data

[63] Continuation of Ser. No. 354,004, Mar. 2, 1982, abandoned.

[30] Foreign Application Priority Data

| | | | |
|---|---|---|---|
| Apr. 7, 1981 | [JP] | Japan | 56-51268 |
| Apr. 7, 1981 | [JP] | Japan | 56-51269 |
| Apr. 7, 1981 | [JP] | Japan | 56-51270 |
| May 14, 1981 | [JP] | Japan | 56-71410 |

[51] Int. Cl.[3] ..... B22D 11/10; B22D 27/02

[52] U.S. Cl. ..... 164/468; 164/473; 164/475

[58] Field of Search ..... 164/468, 473, 475, 57.1

[56] References Cited

U.S. PATENT DOCUMENTS

| | | | |
|---|---|---|---|
| 2,197,259 | 4/1940 | Nead | 164/57.1 X |
| 3,726,331 | 4/1973 | Bunting, Jr. | 164/473 |
| 3,911,993 | 10/1975 | Caudill et al. | 164/473 |
| 4,047,556 | 9/1977 | Obinata et al. | 164/473 |
| 4,134,196 | 1/1979 | Yamaji et al. | 164/57.1 X |

FOREIGN PATENT DOCUMENTS

| | | | |
|---|---|---|---|
| 2425903 | 12/1979 | France | 164/468 |
| 537204 | 6/1941 | United Kingdom | 164/57.1 |

*Primary Examiner*—Nicholas P. Godici
*Assistant Examiner*—J. Reed Batten, Jr.
*Attorney, Agent, or Firm*—Flynn, Thiel, Boutell & Tanis

[57] ABSTRACT

A leaded, free-cutting steel is manufactured by a continuous casting process without causing any pollution of the environment or manufacturing apparatus by toxic gases or fumes and in a high yield of lead addition with a high quality, wherein lead, lead alloy, or a composite lead feed material comprising lead or lead alloy covered with a metallic material harmless for the steel such as, for example, aluminum or iron, is directly added to molten steel which is being electromagnetically stirred in the horizontal direction in a mold.

11 Claims, 11 Drawing Figures

METHOD OF MANUFACTURING LEADED FREE-CUTTING STEEL BY CONTINUOUS CASTING PROCESS

This application is a continuation, of U.S. Ser. No. 354,004, filed Mar. 2, 1982 and now abandoned.

BACKGROUND OF THE INVENTION

The present invention relates to a method of manufacturing leaded, free-cutting steel with a high yield of lead addition by a continuous casting process.

Conventionally, in manufacturing leaded, free-cutting steel, lead or lead alloy has been added to molten steel contained in a ladle or to molten steel being poured into an ingot mold. As specific methods for adding lead or lead alloy to the molten steel, there have heretofore been practiced a method involving a direct addition of lead or lead alloy to molten steel being tapped from a furnace into a ladle, a method comprising blowing an inert gas from the bottom of a ladle into molten steel in the ladle so as to partially remove the slag on the surface of the molten steel and expose the surface of the molten steel, and adding lead or its alloy to the exposed molten-steel, and, if desired, thereafter applying mechanical stirring force to the Pb-containing molten steel; and further, as a way of adding the lead component in the pouring step, there has been proposed a method involving projecting shots of lead or lead alloy into the molten steel stream flowing from the bottom of the ladle, using a projecting machine. However, the above conventional methods of adding lead can not successfully achieve leaded, free-cutting steels in which the lead is uniformly distributed. For example, when lead is directly added to molten steel in a ladle, the molten steel is required to be fully stirred in order to achieve an uniform distribution of lead therein. If the molten steel is not sufficiently stirred, lead is apt to sink to the base part of the steel because lead has a heavy specific gravity compared with iron. As a result, distribution of lead in the product is not uniform. Further, in the above conventional methods, an unfavorable sedimentation of lead occurs during the solidification of the lead-containing molten steel in an ingot mold, decreasing the uniformity of lead distribution. Particularly, when free-cutting steel containing a relatively large amount of lead is desired, much lead should be added to the molten steel, taking the vaporization of lead into consideration, because lead is apt to vaporize during the production process. In this case, the uniformity of the lead distribution in the steel is greatly decreased and the yield of lead addition will be reduced. Further, lead is very toxic, and, thus, not only are special considerations and expensive, complicated facilities inevitably required to treat fire bricks of a ladle or runner bricks used for producing ingots which have been polluted by lead, but also lead vapor generated in the production process should be collected to avoid diffusion in the atmosphere. Thus, expensive collecting equipment is needed to collect toxic gases or fumes not merely in some limited areas but rather in the entire factory. Further, if a conventional continuous casting process which has not been applied to the manufacturing of leaded, free-cutting steel is applied to the manufacturing of leaded, free-cutting steel, without any modification, bricks from a tundish will be polluted by lead and the above problems will be presented.

BRIEF SUMMARY OF THE INVENTION

It is an object of the present invention to eliminate the disadvantages and problems associated with the conventional production methods, and more particularly to provide a novel method for manufacturing leaded, free-cutting steel by a continuous casting process, in which lead is uniformly distributed, without requiring the use of complicated, expensive facilities for treating toxic substances. According to the present invention, the leaded, free-cutting steel having an uniform distribution of lead is produced in a continuous casting process in which lead or lead alloy is directly added to molten steel in a mold while pouring the molten steel from a tundish into the mold. In the step of adding lead or its alloy, an upper portion of the molten steel in the mold is uniformly stirred in a horizontal direction by electromagnetic force. Toxic gases and fumes generated in the production process are forced into a hood arranged on the mold and collected in a predetermined place. Thus, environmental pollution is not caused. In the manufacturing method of the present invention, lead or lead alloy is used in the form of a wire rod or particles. Further, the lead or lead alloy may be replaced by lead or lead alloy covered with a metallic material harmless for the steel such as, for example, aluminum or iron. The toxic substances are scarcely generated due to the covering of the harmless metallic material, and, thus, the above hood may be omitted.

Further, in accordance with the method of the present invention, when the electromagnetic stirring force applied in the horizontal direction of the molten steel in the mold is strengthened, there can be obtained a leaded, free-cutting steel having a higher lead content in an outer part thereof than in the central part. Such leaded, free-cutting steel having a Pb-rich surface layer exhibits an increased machinability.

The above and the other advantages and features of the present invention will become more clear to those skilled in the art from the following preferred embodiments of the present invention and the accompanying drawings.

BRIEF DESCRIPTION OF DRAWINGS

FIG. 4 shows test results manifesting the effect of the present invention, and FIG. 5 is a view showing the portions that were measured.

FIG. 6 illustrates an adding method in which a lead or lead alloy wire rod is introduced in the mold while shielding the top part of the mold with an inert gas, for example, argon or nitrogen.

FIG. 7 is a schematic view illustrating an adding method wherein particles of lead or lead alloy are flowed into a mold through an appropriate guide pipe.

FIG. 8 shows an adding method wherein a lead or lead alloy wire rod is introduced in the molten steel through the inlet opening formed in a side wall of a passageway between a tundish and a mold.

FIG. 9 shows a method for adding particles of lead or lead alloy through a conduit of a stopper serving to introduce the particles into a mold, FIG. 10 shows an adding way similar to the way shown in FIG. 9, substituting the lead or lead alloy wire rod for the lead or lead alloy particles, and FIG. 11 shows an adding method similar to the method shown in FIG. 9, using a stopper having a porous plug in the end portion of the conduit of the stopper.

DETAILED DESCRIPTION OF THE PREFERRED EMBODIMENTS

Figure 1:
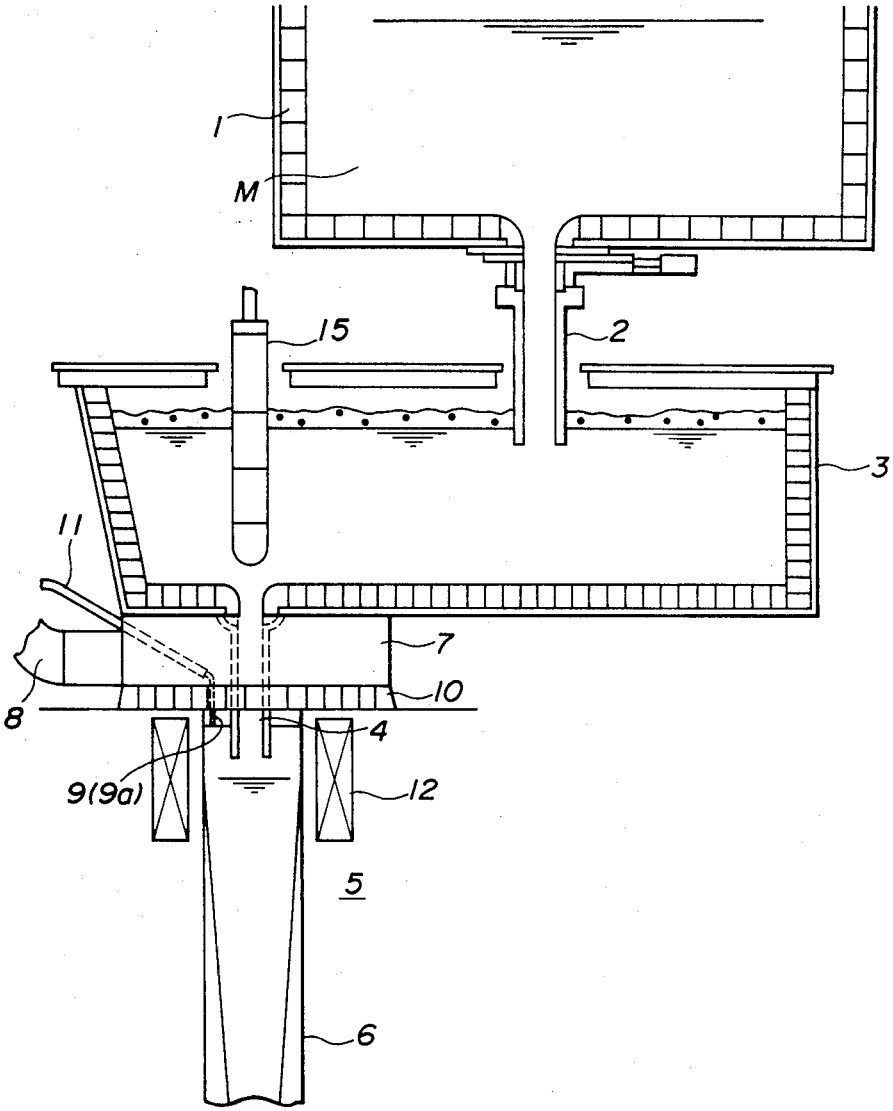
FIG. 1 is an explanatory view illustrating one preferred embodiment of this invention.

According to the present invention, there is provided a method for manufacturing a leaded, free-cutting steel by a continuous casting process wherein lead or lead alloy in the form of a wire or particles is added directly to molten steel in a mold while pouring the molten steel from a tundish into the mold. During the addition of the lead or lead alloy, the upper portion of the molten steel in the mold is uniformly stirred in a horizontal direction by means an electromagnetic stirring force. In the above method of the present invention, the bare lead or lead alloy may be replaced by a composite lead or lead alloy comprising lead or lead alloy covered or coated with a metallic material harmless for the steel, such as, for example, aluminum or iron.

The present invention will be better understood from the following preferred embodiments taken in connection with the accompanying drawings.

In a preferred embodiment of the present invention, when the molten steel in the tundish is poured into the mold, at least one lead feed material selected from the group consisting of lead, lead alloy, lead covered with the metallic material harmless for the steel, and lead alloy covered with the metallic material harmless for the steel is added directly to the molten steel in the mold while uniformly stirring the upper portion of the molten steel in the mold in a horizontal direction by means of an electromagnetic stirring force. In the embodiment, a hood is arranged on the mold so as to exhaust any toxic gases and fumes generated from the mold and to force them to be collected in a predetermined place.

The above preferred embodiment of the present invention will be more clearly understood from the following description taken in connection with accompanying drawings, in which like reference characters designate like or corresponding parts throughout.

FIG. 1 illustrates one example according to the above embodiment. For the continuous production of cast leaded steels contemplated by the present invention, molten steel M is placed in a ladle 1, introduced into a tundish 3 through a nozzle 2, and then poured from the tundish 3 into a mold 5 provided with an electromagnetic stirrer 12 through a passageway 4. By the continuous procedures, leaded steel cast billets 6 can be continuously produced. The electromagnetic stirrer 12 stirs uniformly and horizontally the upper portion of the molten steel M in the mold 5. A top part of the mold 5 and an area surrounding an inlet of the passageway 4 are covered with a hood 7 to prevent toxic gases and fumes from diffusing and polluting the atmosphere. The toxic gases and fumes drawn into the hood 7 are collected in a predetermined place through a duct 8. A lead or lead alloy wire rod 9, which is inserted in a guide pipe 11 passing through the duct 8 and open to the mold 5, is fed to the upper portion of the molten steel M being electromagnetically and uniformly stirred in the horizontal direction. As above mentioned, the lead or lead alloy wire rod 9 may be replaced by a lead or lead alloy wire rod **9*a* covered with the harmless metallic material for the steel, such as, for example, aluminum or iron. Hereinafter, the lead or lead wire rod covered with the harmless metallic material is referred to as "composite wire rod" for brevity. The composite wire rod 9*a* is produced, for example, by enclosing or wrapping lead or lead alloy in an appropriate harmless metallic material, such as aluminum, iron or the like, in the form of a hoop, a tape or the like. In the production process, the feeding rate of the lead feed material, that is, the lead or lead alloy wire rod 9 or the composite wire rod 9*a*, is appropriately controlled according to the amount of the molten steel M being poured into the mold 5**.

Further, in FIGS. 6 through 11, further modified ways for adding lead or lead alloy are shown and these ways can be applied to the embodiment set forth above.

Since the tundish 3 moves slightly upwardly and downwardly, a base part 10 of the hood 7 is mounted flexibly on the mold 5.

In such mode, the lead feed material is directly added to the molten steel M in the mold 5, whereby fire bricks used in the ladle 1 and the tundish 3 are free of the foregoing pollution problem. Further, since the lead-feed material is added to a relatively small area of the molten steel M contained in the mold 5 and is being electromagnetically stirred in the horizontal direction, the lead-feeding material is uniformly mixed with the molten steel M. Further, the toxic gases or fumes generated by the reaction between the lead and the molten steel M are limited to a relatively small area of the mold 5 and, thus, removal is required only in the limited narrow area generating the toxic gases or fumes and its surrounding area. Thus, expensive exhaust facilities and equipment of large dimensions are not needed. Further, in the method of the present invention, the conventional ladle and tundish employed in an ordinary continuous casting can be used without requiring the use of a specially prepared ladle and tundish. Such advantages reduce significantly the production cost compared with the conventional method.

In order to show the superiority of the method according to the present invention over the conventional method, the leaded, free-cutting steel of the present invention prepared by the continuous casting process was compared with the leaded, free-cutting steel produced by the conventional method involving adding lead particles to a molten steel in a ladle, and thereafter casting the steel in an ingot mold.

Specifications of an electromagnetic stirrer used in the production process of the present invention are described in Table 1.

TABLE 1

| | |
|---|---|
| Installation position of electromagnetic stirrer | In the mold |
| Stirring means | Rotating magnetic field in the horizontal direction |
| Related capacity | 90 KVA |
| Maximum electric current | 400 A |
| Maximum voltage | 76 V |
| Frequency | 3–10 Hz |

As a result of the comparative test, the method of the present invention gave a high average yield of lead addition of 75% and the conventional method gave an inferior yield of 35 to 60%. Further, the hood 7 described above effectively exhausted the toxic gases and fumes at the rate of 30 $m^3$/min, and this exhaust capability means that 98% of total amount of generated toxic gases and fumes were caught by the hood 7.

As above mentioned, the present invention makes possible a high adding efficiency of lead or lead alloy and provides a highly useful method in the manufacture of leaded, free-cutting steels without causing pollution of the environment and fire bricks of the ladle or tundish and the related problems.

In the following, an excellent uniformity of lead distribution, which is the best advantage of the present invention, is shown in comparison with the conventional method.

For the comparative test, there were provided a cast billet having a cross section of 130 mm by 130 mm produced by the continuous casting method of the present invention involving directly adding lead wire rod to molten Cr-V steel being stirred electromagnetically in a mold, and a conventional billet having a cross section of 130 mm by 130 mm produced by a conventional practice involving adding lead to the molten Cr-V steel in a ladle, casting and then rolling. The molten Cr-V steel used in the test had the composition shown in Table 2.

TABLE 2

| Composition (wt. %) | | | | | | | | | | |
|---|---|---|---|---|---|---|---|---|---|---|
| C | Si | Mn | P | S | Ni | Cr | Mo | V | Pb | Fe |
| 0.40 | 0.27 | 0.74 | 0.017 | 0.021 | 0.11 | 0.55 | 0.04 | 0.11 | 0.06 | Balance |

To examine the uniformity of lead distribution with respect to the longitudinal direction of the respective test specimens, lead contents were measured at the following portions of the respective test specimens and the test results are shown in the following Table 3.

TABLE 3

| | [Pb] × $10^{-2}$ wt. % | |
|---|---|---|
| Tested Portions | Billet of the Present Invention | Conventional Billet |
| Top | 6.8 | 6.2 |
| Middle | 6.3 | 8.0 |
| Bottom | 6.5 | 8.0 |

The test results obtained were the beforementioned yields and this means that the conventional method used a greater amount of lead compared with the present invention.

Figure 2:
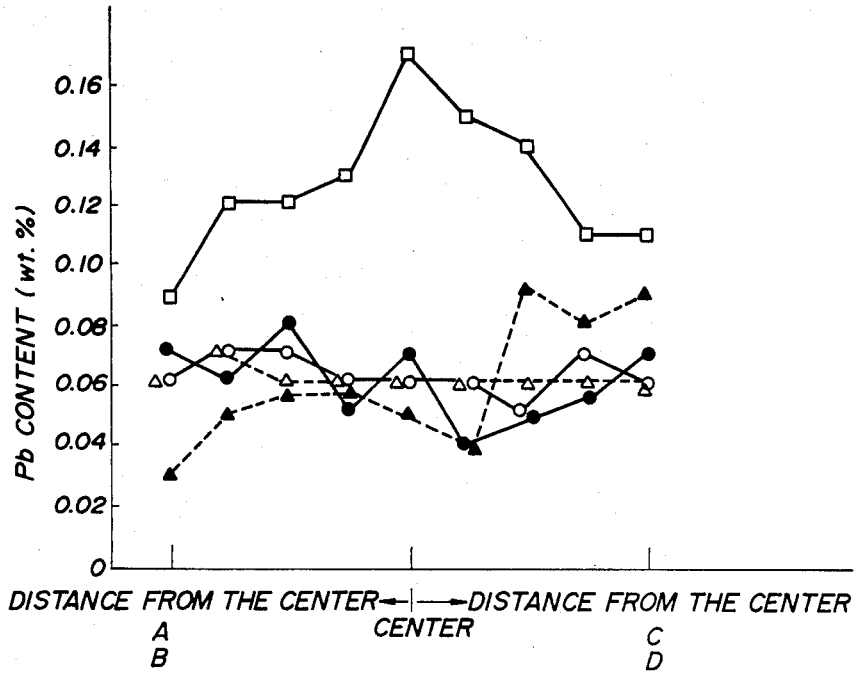
FIG. 2 shows test results of the embodiment.
Figure 3:
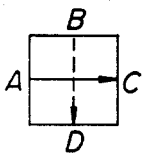
FIG. 3 illustrates portions measured to obtain the test results of FIG. 2.

Further, to examine the lead distribution of a transverse cross section of the billet of the present invention, lead contents were measured in the respective directions from A to C (A→C) and from B to D (B→D) of the transverse cross section shown in FIG. 3. The results are shown in FIG. 2, in which a solid line (O) shows the lead distribution of from A to C (A→C) and a dotted line (α) shows the lead distribution of from B to D (B→D).

Further, to manifest the effect of the electromagnetic stirring applied in the present invention, lead distribution was examined in a transverse cross section of a comparative billet produced by the same method described above except that the electromagnetic stirring force was not applied to the molten steel in the mold and the results are shown in FIG. 2. A solid line ( ) and a dotted line ( ) show respectively lead distributions of from A to C (A→C) and B to D (B→D) in the transverse cross section. Also, a lead distribution of from A to C (A→C) of a transverse cross section of the conventional billet produced by the conventional practice involving adding lead particles to molten steel in a ladle, casting and rolling was examined and the result is shown by a solid line (□).

It can be seen in the above results that the method of the present invention can provide a highly improved leaded, free-cutting steel having a uniform lead distribution and is free of environmental pollution problems.

Considering theoretically the effect or function of the electromagnetic stirring in the horizontal direction of the mold M, first, an electromagnetic stirrer 12 causes a rotating magnetic field in the mold 5 and the rotating magnetic field passes through the conductive molten steel M, whereby rotating torque acts on the molten steel M according to the principle of an induction motor and stirs horizontally the molten steel M. Thus, if an increased current is applied to the electromagnetic stirrer when the lead or lead alloy-feeding material is added to the molten steel M in the mold 5, the rotating magnetic field is increased and thereby the molten steel M receives a strengthened rotating force. The added lead or lead alloy is dispersed toward the peripheral region of the mold 5 by a centrifugal force effected by the strengthened rotating force and is solidified as it is with the molten steel in a cooling zone. Thus, the produced billet has a high content of lead in an external part thereof, as shown in FIG. 4, and exhibits an increased machinability.

Figure 4:
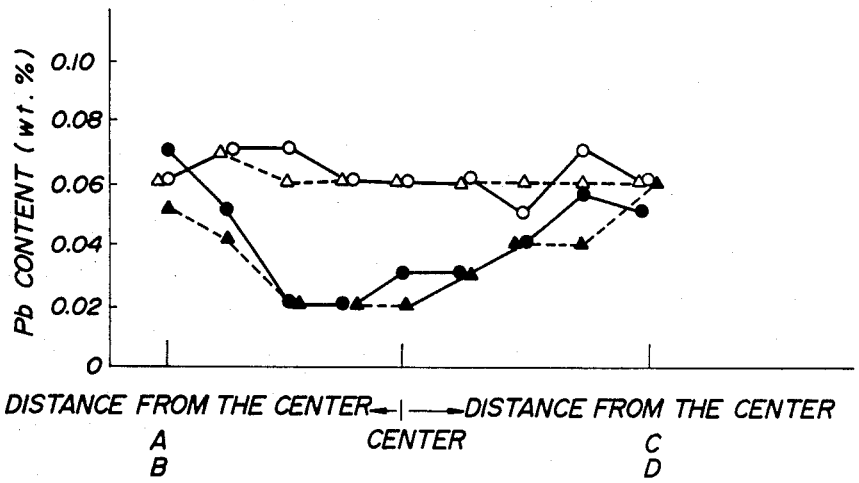
FIGS. 4 and 5 relate to another preferred embodiment for manufacturing a leaded, free-cutting steel having a Pb-rich surface layer part.
Figure 5:
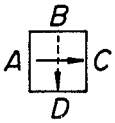

FIG. 4 shows the lead distributions in Cr-V steel billets having a cross section of 130 mm by 130 mm produced using a lead wire rod as a lead-feeding material under the normal electromagnetic stirring conditions and the strengthened electromagnetic stirring conditions. The specifications of electromagnetic stirrers used in the both cases were the same as in the previous Table 1 and, in the case of the strengthened electromagnetic stirring condition, an increased electric current was applied to the stirrer. The measurements of lead content were done in the respective directions of from A to C (A→C) and from B to D (B→D) of transverse cross section, as shown in FIG. 5, and the measurement results are indicated in FIG. 4. In FIG. 4, solid lines show lead distributions of from A to C (A→C) and dotted lines show lead distribution of from B to D (B→D).

Solid symbols, and , show the measurement results of the strengthened stirring conditions and open symbols, o and Δ show the measurement results of the case of the normal stirring conditions. Further, as to the addition amount of lead, in the case of the increased electromagnetic stirring force, the addition amount was 0.5 kg/T. On the other hand, in the case of the normal magnetic stirring force, the addition amount of lead was 0.8 kg/T. From FIG. 4 it becomes immediately clear that the strengthened electromagnetic stirring force effected by the increased electric current can provide a leaded, free-cutting steel having a higher lead content in its external part, a lower lead content in its central part, and a high machinability. The high lead content in the external part was well comparable with the lead content of the leaded, free-cutting steel produced under the normal stirring conditions, although the total amount of lead used in the case of strengthened stirring conditions was smaller than that of the other case.

In the manufacturing method of the present invention, the method of addition of lead or lead alloy is not limited to the above ways. The following methods of addition shown in FIGS. 6 through 11 can be appropriately practiced in the method of the present invention, for example, shown in FIG. 1.

Figure 6:
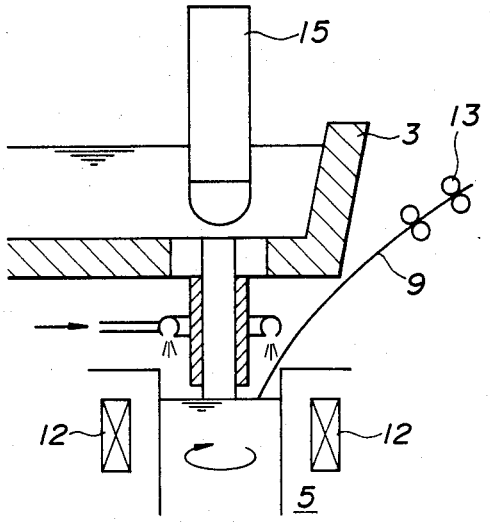
FIGS. 6-11 are schematic views showing various ways of adding lead or lead alloy other than the adding method shown in FIG. 1, in accordance with this invention.

In FIG. 6, a lead or lead alloy wire rod 9 is forwarded by a feeding roll 13 and introduced in the molten steel M in the mold 5 while shielding the upper part of the mold 5 with an atmosphere of an inert gas such as argon, nitrogen, etc.

Figure 7:
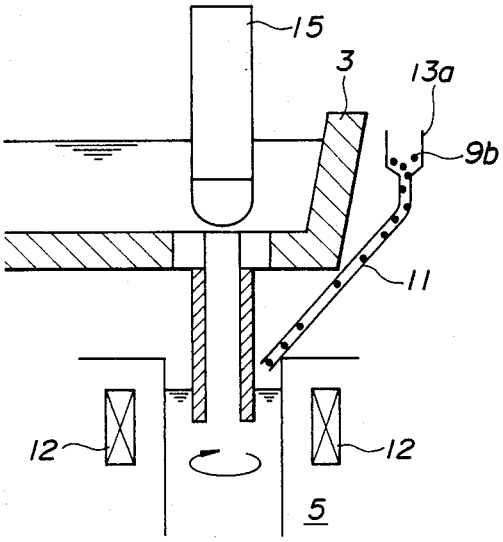
Figure 8:
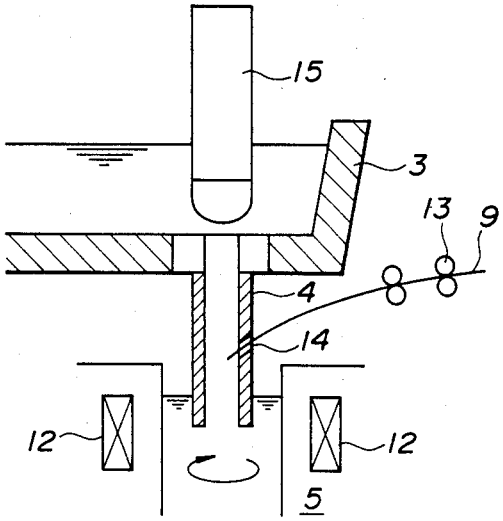

FIG. 7 shows a method of addition wherein lead or lead alloy particles **9*b* are flowed from a feeder 13*a* into the mold 5 through a guide pipe 11. In FIG. 8, lead or lead alloy wire rod 9 is inserted into an upward inlet opening 14 formed in a side wall of the passageway 4 and introduced to the molten steel M of the mold 5**.

Figure 9:
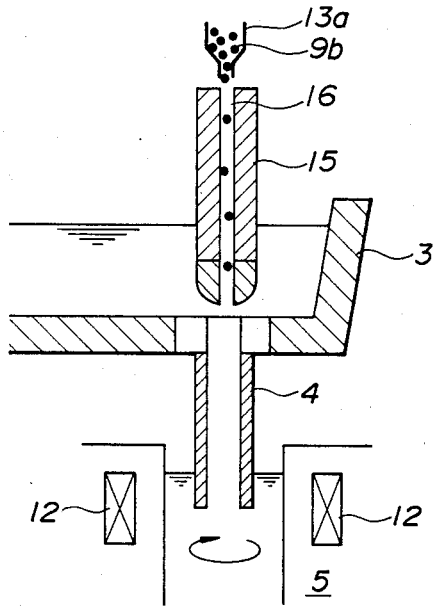
Figure 10:
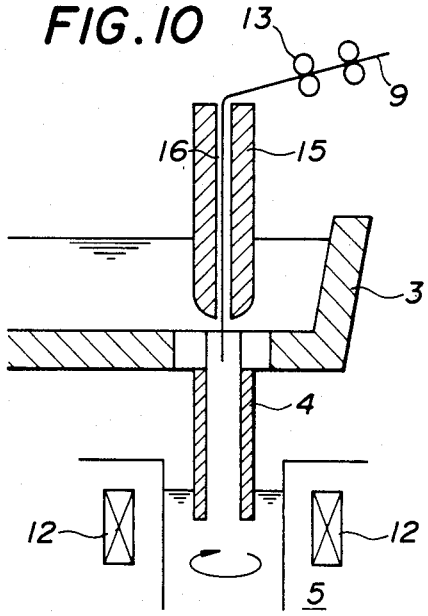

FIG. 9 shows a further addition method wherein lead or lead alloy particles **9*b* are added to the molten steel M in the mold 5 through a conduit 16 formed in the center of a stopper 15. In FIG. 10, the lead or lead alloy wire rod 9 is forwarded by the feeding roll 13 and introduced in the passageway 4 through the conduit 16** set forth above.

Figure 11:
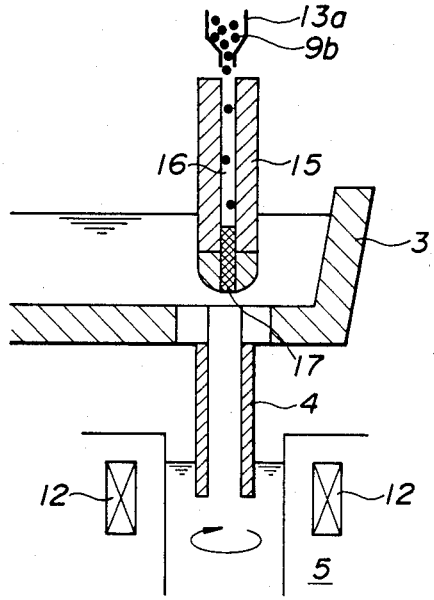

FIG. 11 shows a further modified method of addition similar to the way shown in FIG. 9, wherein the conduit 16 formed in the stopper 15 has a porous plug 17 through which the molten lead or lead alloy particles **9*b* penetrate and flow into the mold 5, and thereby air is not absorbed in the mold 5**.

Of course, in any addition method shown in FIGS. 6, 8 and 10, the bare lead or lead alloy wire rod 9 may be replaced by the composite wire rod **9*a***.

As above mentioned, according to the present invention, leaded, free-cutting steels having uniform dispersion of lead or having a lead-rich surface can be readily produced in a high yield of lead addition using a simple apparatus and simplified steps. Further, the method can be practiced without causing any pollution of the manufacturing apparatus and the atmosphere. Thus, the use of special facilities for treating the toxic substances inevitably required in the conventional methods are not needed.

What is claimed is:

1. A method of manufacturing steel containing an effective, uniformly distributed amount of lead, comprising:

pouring molten, refined steel into a ladle;

feeding said molten steel to a tundish;

continuously pouring said molten steel, at a selected rate, from said tundish through downwardly extending passage means of said tundish into the upper portion of an upright continuous casting mold associated with said tundish, which mold is substantially filled near the top thereof with molten steel, and which passage means extends beneath the upper surface of said molten steel in said mold, while simultaneously adding, at a selected rate, to the upper surface of said molten steel in said upper portion of said mold, above and laterally offset from said molten steel being poured into said mold through said passage means from said tundish, a lead feed material selected from the group consisting of lead, lead alloys, lead surface coated with a metallic material, and lead alloys coated with said metallic material, said metallic material being essentially free of lead and being composed of one or more suitable metals which do not adversely affect the properties of said steel, which lead feed material melts in contact with said molten steel to form a molten mixture in said upper portion of said mold, while simultaneously uniformly horizontally stirring said mixture in said upper portion of said mold by means of electromagnetic stirring force whereby said lead feed material is substantially uniformly mixed throughout said molten steel in said upper portion of said mold.

2. A method as claimed in claim 1, wherein said lead feed material is in the form of particles.

3. A method as claimed in claim 1, including the step of removing gases produced by said molten mixture from said upper portion of said mold.

4. A method as claimed in claim 1, including the step of substantially completely preventing the dissipation of toxic gases produced by said molten mixture from said upper portion of said mold into the ambient atmosphere.

5. A method as claimed in claim 1, wherein said lead feed material is added into said molten steel in said mold at a position horizontally offset from said passage means, and including the step of withdrawing gases issuing from said upper portion of said mold by means of an enclosed hood covering said upper portion of said mold and feeding said gases through duct means communicating with said enclosed hood by applying suction to said duct means.

6. A method as claimed in claim 1, wherein said lead feed material is added into said molten steel in said mold at a position horizontally offset from said passage means, and including the step of directing an inert gas against the upper portion of said mold.

7. A method as claimed in claim 6, wherein said lead alloy material is a wire, and said wire is fed end-first into said molten steel in said upper portion of said mold.

8. A method as claimed in claim 1, wherein said lead feed material is in the form of particles, and said particles are continuously added into said molten steel in said upper portion of said mold at a position horizontally offset from said passage means.

9. A method as claimed in claim 1, wherein said lead feed material is selected from the group consisting of said coated lead and said coated lead alloy, wherein said metallic material is aluminum or iron.

10. A method of manufacturing steel containing an effective amount of lead, comprising introducing molten steel into a tundish; continuously pouring said molten steel, at a selected rate, from said tundish through downwardly extending passage means of said tundish into the upper portion of an upright continuous casting mold associated with said tundish, which mold is substantially filled near the top thereof with molten steel, and which passage means extends beneath the upper surface of said molten steel in said mold, while simultaneously adding to the upper surface of said molten steel in said upper portion of said casting mold, at a selected rate, above and laterally offset from said molten steel being poured into said mold through said passage means from said tundish, a lead feed material selected from the group consisting of lead, lead alloys, lead surface coated with a metallic material, and lead alloys coated with said metallic material, said metallic material being essentially free of lead and being composed of one or more suitable metals which do not adversely affect the properties of said steel, which lead feed material melts in contact with said molten steel to form a molten mixture in said upper portion of said mold, while simultaneously uniformly horizontally stirring said mixture in said upper portion of said mold by means of electromagnetic stirring force of a strength sufficient to cause said steel, when hardened, to have a higher lead content in peripheral portions thereof than in central portions thereof, whereby said lead feed material is mixed throughout said molten steel in said upper portion of said mold.

11. A method of manufacturing a steel casting containing an effective, uniformly distributed amount of lead, comprising the steps of:

feeding molten, refined steel from a ladle through a downwardly extending nozzle of said ladle into a tundish, which tundish is substantially filled with molten steel, said nozzle extending beneath the surface of said molten steel in said tundish;

simultaneously pouring molten steel, at a selected rate, from said tundish through downwardly extending passage means of said tundish into the upper end of a continuous casting mold, which mold is substantially filled with molten steel, which passage means extends beneath the upper surface of said molten steel in said mold and opens at the downward end thereof, so that said molten steel is poured in the form of a downwardly moving stream into said molten steel within said mold;

simultaneously adding a solid lead feed material consisting essentially of lead at a selected rate through a guide pipe directly to the upper surface of said molten steel in the upper end of said mold, which lead feed material melts upon contact with said molten steel to form a molten mixture of steel and lead in an upper portion of said mold, said lead feed material being added at a position above and laterally offset from said molten steel stream so that said molten steel stream from said tundish does not substantially carry molten lead therewith downwardly in said mold, the rate of feeding of said lead feed material being controlled in proportion to the amount of molten steel poured into said mold to maintain a predetermined weight ratio of said lead feed material to said molten steel;

simultaneously, uniformly and horizontally rotating said mixture in said upper portion of said mold by means of electromagnetic stirring force whereby said lead feed material is stirred and mixed throughout said molten steel in said upper portion of said mold;

simultaneously withdrawing lead-containing vapors by suction through a duct communicating with a hood interposed between the bottom of said tundish and the upper end of said mold, said guide pipe extending through said hood into the interior thereof, said passage means of said tundish extending downwardly through the interior of said hood, a lower end portion of said hood being flexible to allow vibration of said mold during stirring; and simultaneously continuously moving said molten steel downwardly in said mold and solidifying same to form a casting.

* * * * *